US010926126B2

(12) United States Patent
Ngene

(10) Patent No.: US 10,926,126 B2
(45) Date of Patent: Feb. 23, 2021

(54) MODULAR EXERCISE SYSTEM

(71) Applicant: James Ngene, St. Paul, MN (US)

(72) Inventor: James Ngene, St. Paul, MN (US)

( * ) Notice: Subject to any disclaimer, the term of this patent is extended or adjusted under 35 U.S.C. 154(b) by 0 days.

(21) Appl. No.: 16/413,211

(22) Filed: May 15, 2019

(65) Prior Publication Data

US 2020/0360758 A1 Nov. 19, 2020

(51) Int. Cl.
*A63B 21/16* (2006.01)
*A63B 21/00* (2006.01)
*A63B 21/04* (2006.01)

(52) U.S. Cl.
CPC .... *A63B 21/1645* (2013.01); *A63B 21/00043* (2013.01); *A63B 21/04* (2013.01); *A63B 21/4035* (2015.10)

(58) Field of Classification Search
CPC ..... A63C 21/00043; A63C 21/04; A63C 21/4035; A63C 21/1618–1663; E05C 17/54
See application file for complete search history.

(56) References Cited

U.S. PATENT DOCUMENTS 947,805 A * 2/1910 Dumont ..... E05C 17/54 292/343
6,322,483 B1 11/2001 Rotella
6,908,418 B2 6/2005 Saure
8,043,197 B2 10/2011 Hetrick
8,083,653 B2 12/2011 Hetrick
8,840,075 B2 9/2014 Dalebout
9,028,381 B2 5/2015 Metsmaker
9,636,535 B2 5/2017 Schleiden, II
9,839,805 B2 12/2017 Demarco
2003/0186792 A1* 10/2003 Keeler ..... A63B 21/1645 482/129
2004/0087420 A1* 5/2004 Montesquieux ... A63B 23/0355 482/129
2015/0031512 A1* 1/2015 Schleiden, II ..... A63B 23/1209 482/139

* cited by examiner

*Primary Examiner* — Jennifer Robertson

(57) ABSTRACT

A modular exercise system includes a first strap that has a first end, a second end, a first side, and a second side. The first strap is extendable around a door. A coupler is attached to the first end and receiving the second end to form a closed loop. A demarcation line is defined on the first strap to partition the first strap into a first portion and a second portion. The first portion includes the first end and the second portion includes the second end. A second strap is attached to the first portion at a first attachment point and is attached to the second portion at a second attachment point. The second strap is configured to be positioned over an upper edge of a door. The exercising system is configured to engage a resistance band to releasably secure the resistance band to the door.

18 Claims, 5 Drawing Sheets

MODULAR EXERCISE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercising assisting device and more particularly pertains to a new exercising assisting device for allowing a person to utilize a household door as an anchor for resistance band training.

(2) Description of Related Art Including Information Disclosed Under 37 CFR 1.97 and 1.98

The prior art relates to exercising assisting device and more particularly the type of exercising assisting device that allows a person to extend a resistance band between themselves and an anchor point.

BRIEF SUMMARY OF THE INVENTION

An embodiment of the disclosure meets the needs presented above by generally comprising a first strap that has a first end, a second end, a first side, and a second side. The first strap is extendable around a door. A coupler is attached to the first end and receiving the second end to form a closed loop. A demarcation line is defined on the first strap to partition the first strap into a first portion and a second portion. The first portion includes the first end and the second portion includes the second end. A second strap is attached to the first portion at a first attachment point and is attached to the second portion at a second attachment point. The second strap is configured to be positioned over an upper edge of a door. The exercising system is configured to engage a resistance band to releasably secure the resistance band to the door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
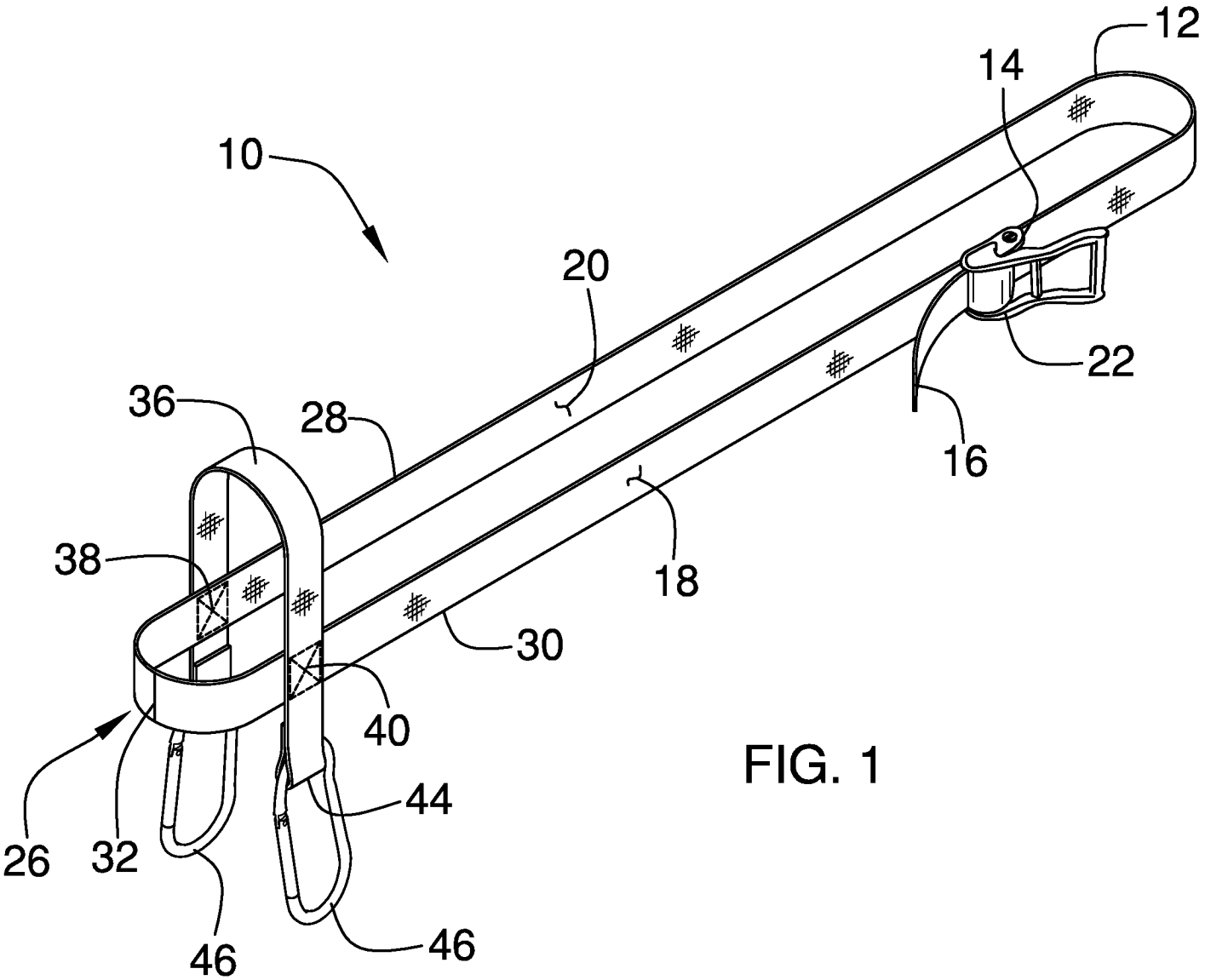
FIG. 1 is a front isometric view of a modular exercise system according to an embodiment of the disclosure.
Figure 2:
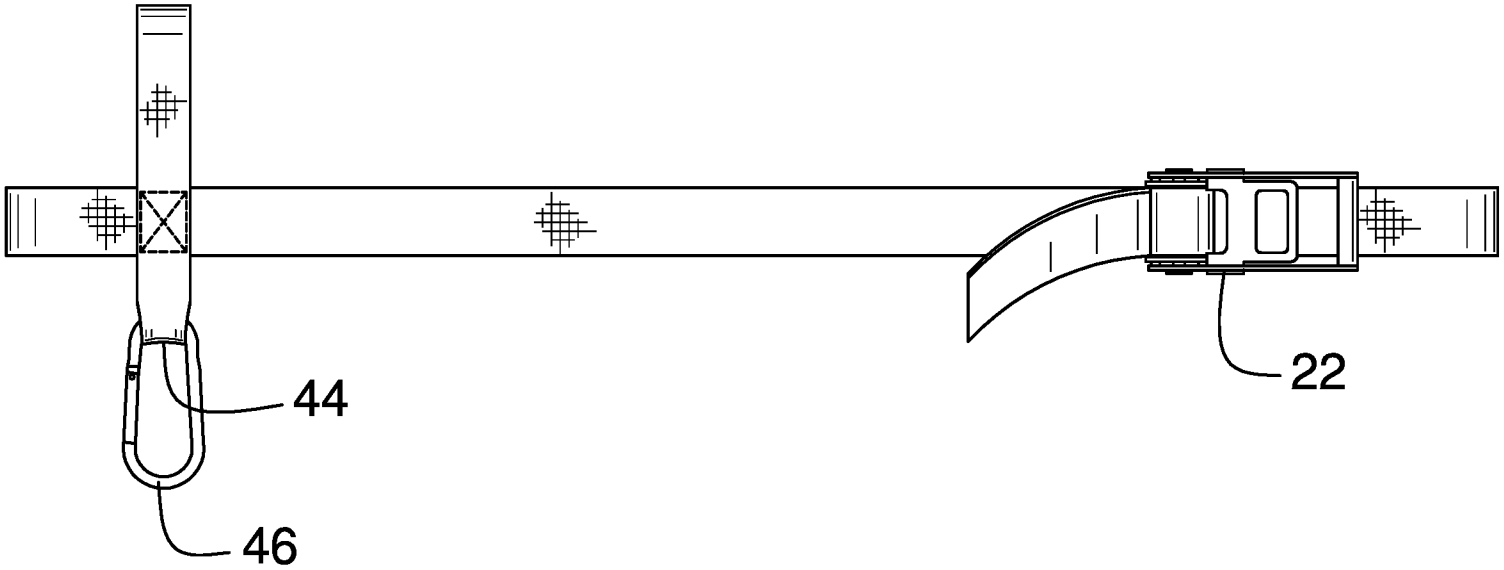
FIG. 2 is a front view of an embodiment of the disclosure.

With reference now to the drawings, and in particular to FIGS. 1 through 5 thereof, a new exercising assisting device embodying the principles and concepts of an embodiment of the disclosure and generally designated by the reference numeral 10 will be described.

As best illustrated in FIGS. 1 through 5, the modular exercise system 10 generally comprises a first strap 12 that has a first end 14, a second end 16, a first side 18, and a second side 20. The first strap 12 is configured to be extendable around a door. The first strap 12 may be comprised of any conventional, flexible strapping material including, for example, a flat, nylon webbing material. A coupler 22 is attached to the first end 14 and receives the second end 16 to form a closed loop. The coupler 22 is preferably adjustable to select and alter a size of the closed loop. In one embodiment, the coupler 22 may comprise a ratcheting coupler allowing the user to tightly secure the first strap 12 to a door 24 by ratcheting the first strap 12 through the coupler 22. However, other couplers 22 may be utilized such as using a conventional double ring connector, belt buckles, hook and loop securing members in combination with a single ring and the like. The first strap 12 will typically have a length from the first end 14 to the second end which is greater than 60.0 inches and less than 90.0 inches.

A demarcation line 26 is defined on the first strap 12 to partition the first strap 26 into a first portion 28 and a second portion 30. The first portion 28 includes the first end 14 and the second portion 30 includes the second end 16. The demarcation line 26 is less than 30.0 inches, and typically be between 12.0 inches and 26.0 inches, from either one of the first 14 or second 16 ends, though which of the first 14 or second 16 ends it is closer to is not of importance. This length ensures that the coupler 22 is properly positioned relative to the door 24 and remaining elements of the system 10. The demarcation line 26 may be marked with line indicia 32 used to align an outer edge 34 of the door 24 with the demarcation line 26.

A second strap 36 is attached to the first portion 28 at a first attachment point 38 and is attached to the second portion 30 at a second attachment point 40. However, instead of attachment points 38, 40, the first 12 and second 36 straps may be a unitary structure wherein the attachment points 38, 40 would instead be defined as intersection points. The second strap 36 will typically be constructed of the same material as the first strap 12. The second strap 12 is configured to be positioned over an upper edge 42 of the door 24. A length of the second strap 36 from the first attachment point 38 to the second attachment point 40 will typically be less than 18.0 inches. The second strap 36 may extend beyond each of the first 38 and second 40 attachment points to define a pair of free ends 44. Each of the free ends 44 typically extends away from the first strap 12 a distance of between 2.0 inches and 12.0 inches. The first 38 and second 40 attachment points are equidistant from the demarcation line 26 so that when the demarcation line 26 is aligned properly with the edge 34 of the door 24, the free ends 44 are spaced evenly from the outer edge 34 of the door 24. The first 38 and second 40 attachment points will most generally be less than 8.0 inches from the demarcation line 26.

Each of the free ends 44 can be formed into a closed loop so that articles may be easily attached to the free ends 44. However, more often, a pair of ring clips 46 is provided so that each of the free ends 44 has one of the ring clips 46 attached thereto. The ring clips 46 may be conventional carabiner type clips. Alternatively, the ring clips 46 may be attached directly to the first strap 12 or at juncture of the first 12 and second 36 straps. If ring clips 46 are not used, alternate securing members may be used such as hooks, for example. The second strap 36 may be attached to the first side 18 of the first strap 12 at each of the first 38 and second 40 attachment points. Also, the free ends 44 may be a separate structure from the second strap 36 though it would be beneficial to have the free ends 44 still aligned with the second strap 36.

Figure 3:
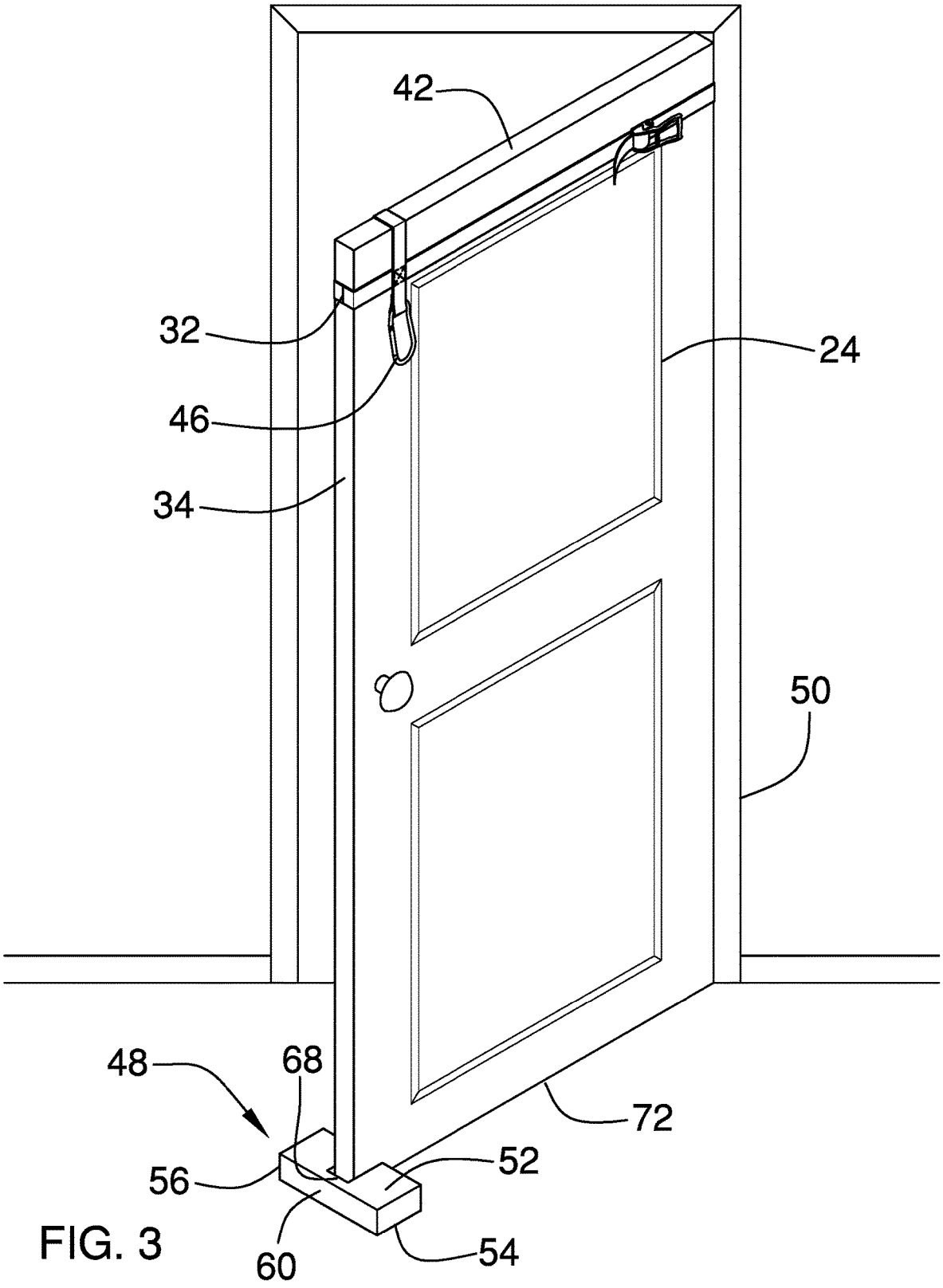
FIG. 3 is a front isometric view of an embodiment of the disclosure.
Figure 4:
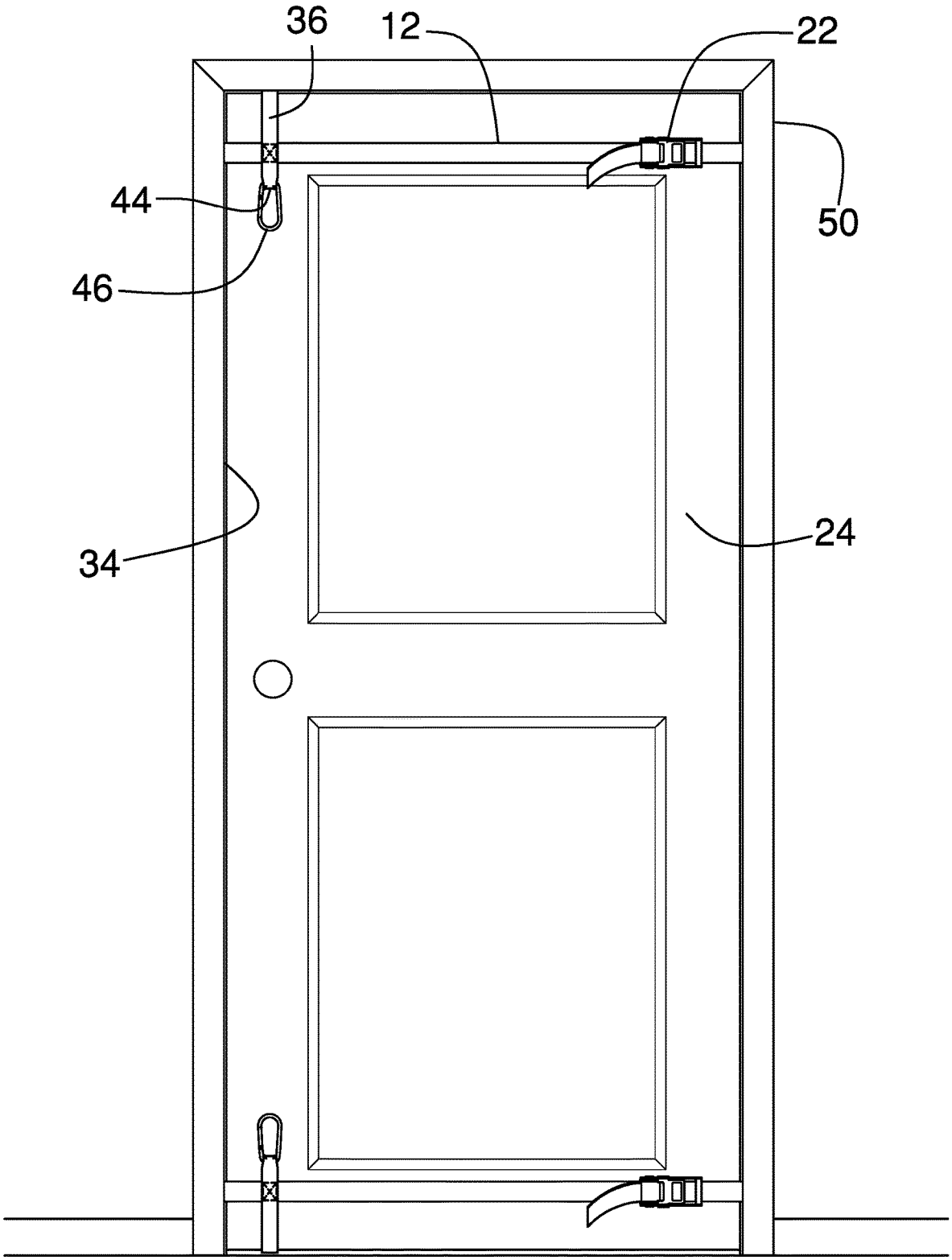
FIG. 4 is a front view of an embodiment of the disclosure.
Figure 5:
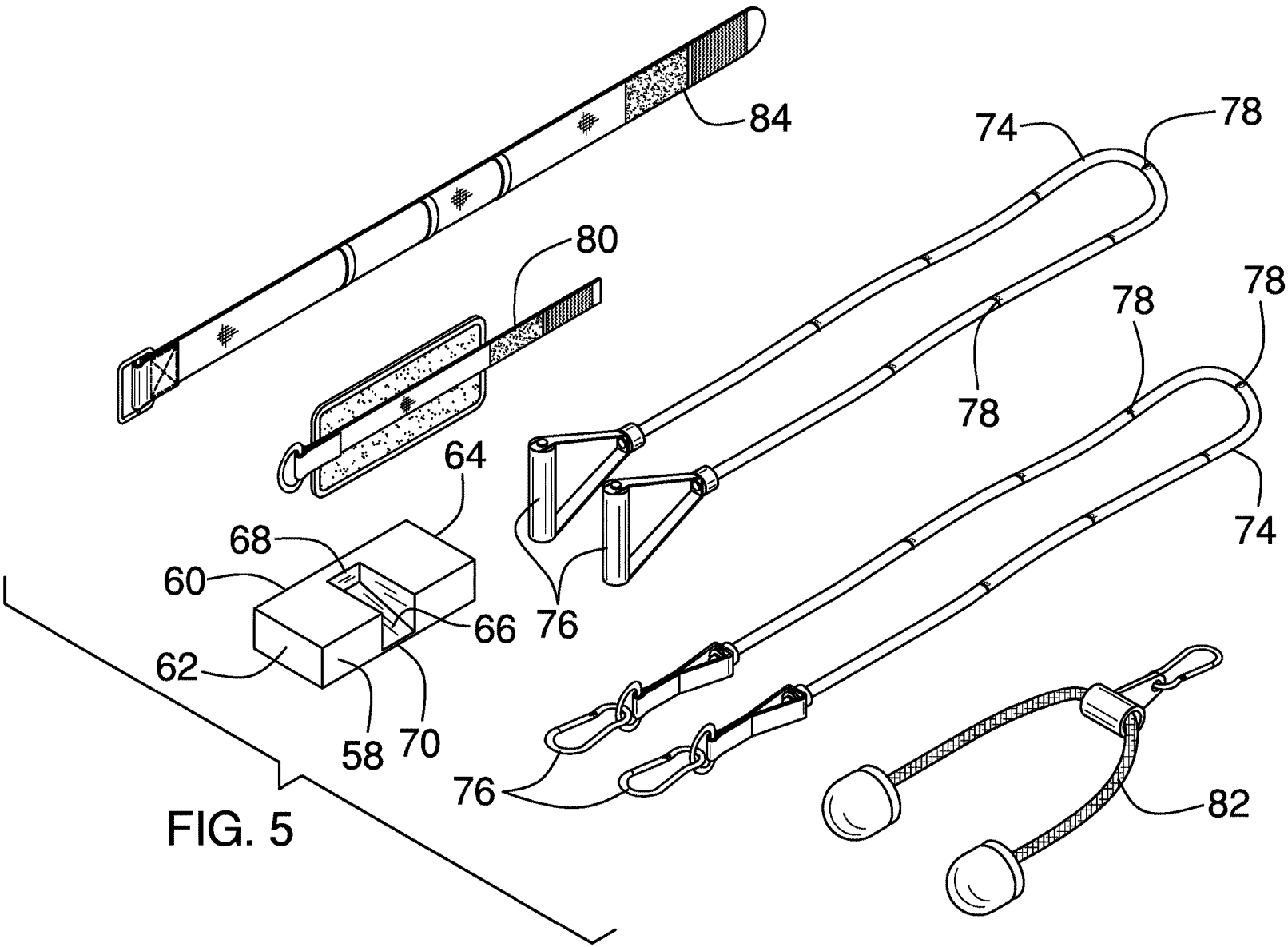
FIG. 5 is a front isometric view of multiple exercise enhancing components of an embodiment of the disclosure.

A stop 48 is provided which is configured for engaging the door 24 to prevent movement of the door 24 relative to a door frame 50 that the door 24 is pivotally coupled to. The stop 48 comprises a block having a top side 52, a bottom side 54, and perimeter wall 56 extending between the top 52 and bottom 54 sides. The perimeter wall 56 includes a front wall 58, rear wall 60, first side wall 62 and second side wall 64. The block has a notch 66 therein extending into the front wall 58 and upwardly through the top side 52. The notch 66 has a width typically between 1.0 inches and 3.0 inches and is angled downwardly from a top edge 68 of the notch 66 positioned adjacent to the rear wall 60 to a bottom edge 70 of the notch 66 positioned adjacent to the bottom side 54. The bottom edge 70 is thereby slidable under a lower edge 72 of the door 24 as shown in FIG. 3 to receive the outer edge 34 and frictionally engage the door 24 and flooring beneath the door 24. The stop 48 is comprised of a resiliently compressible material.

Once the first strap 12 is attached to the door 24, the system 10 includes a plurality of exercise assistance implements that are attachable to the door 24 via the first 12 and second 36 straps. These exercise assistance implements may include resistance bands 74. The resistance bands 74 may include terminal ends 76 with grips or couplers and further may include alignment indicia 78 to align center of the resistance bands 74 with the with the ring clips 46, for example, or alter the resistance of the resistance bands 74 by using alignment indicia 78 which are not centrally located. Ankle straps 80 are provided which are extendable around a person's leg and are attachable to the resistance bands 74 to exercise the legs, while rope handles 82 and waist belts 84 are attachable to the resistance bands to perform a wide variety of total body and arm exercises.

In use, as is obvious from the above, the user can use the system 10 to provide a wide range of exercises with those noted herein only being a few thereof. The arrangement of the first 12 and second 36 straps allows a person to effectively utilize a door 24 as an anchor point for resistance type exercises without damaging the door 24 and ensuring that the system 10 will not move during the workout or be uneven in positioning on the door 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercising system comprising:

a first strap having a first end, a second end, a first side, and a second side, the first strap being configured to be extendable around a door, a coupler being attached to the first end and receiving the second end to form a closed loop;

a demarcation line being defined on the first strap to partition the first strap into a first portion and a second portion, the first portion including the first end and the second portion including the second end, the demarcation line being less than 30.0 inches from one of either the first or second ends;

a second strap being attached to the first portion at a first attachment point and being attached to the second portion at a second attachment point, the second strap being configured to be positioned over an upper edge of a door, a length of the second strap from the first attachment point to the second attachment point being less than 18.0 inches, the second strap extending beyond each of the first and second attachment points to define a pair of free ends, each of the free ends extending away from the first strap a distance of between 2.0 inches and 12.0 inches, wherein the resistance band is attachable to the free ends; and wherein the exercising system is configured to engage a resistance band to releasably secure the resistance band to the door.

2. The exercising system according to claim 1, wherein the coupler is adjustable to select a size of the closed loop.

3. The exercising system according to claim 2, wherein the coupler comprises a ratcheting coupler.

4. The exercising system according to claim 1, wherein the first strap has a length from the first end to the second being greater than 60.0 inches and less than 90.0 inches.

5. The exercising system according to claim 1, wherein the first and second attachment points are less than 8.0 inches from the demarcation line.

6. The exercising system according to claim 1, wherein each of the free ends forms a closed loop.

7. The exercising system according to claim 1, further including a pair of ring clips, each of the free ends having one of the ring clips attached thereto.

8. The exercising system according to claim 1, further including a stop being configured for engaging the door to prevent movement of the door relative to a door frame the door is pivotally coupled to.

9. The exercising system according to claim 8, the stop comprises a block having a top side, a bottom side, and perimeter wall extending between the top and bottom sides, the perimeter wall including a front wall, rear wall, first side wall and second side wall, the block having a notch therein extending into the front wall and upwardly through the top side, the notch being angled downwardly from a top edge of the notch positioned adjacent to the rear wall to a bottom edge of the notch positioned adjacent to the bottom side.

10. The exercising system according to claim 9, wherein the block is comprised of a resiliently compressible material.

11. An exercising system comprising:

a first strap having a first end, a second end, a first side, and a second side, the first strap being configured to be extendable around a door, a coupler being attached to the first end and receiving the second end to form a closed loop;

a demarcation line being defined on the first strap to partition the first strap into a first portion and a second portion, the first portion including the first end and the second portion including the second end;

a second strap being attached to the first portion at a first attachment point and being attached to the second portion at a second attachment point, the second strap being configured to be positioned over an upper edge of a door, the second strap extending beyond each of the first and second attachment points to define a pair of free ends, each of the free ends extending away from the first strap a distance of between 2.0 inches and 12.0 inches, wherein the resistance band is attachable to the free ends; and wherein the exercising system is configured to engage a resistance band to releasably secure the resistance band to the door.

12. The exercising system according to claim 11, wherein the coupler is adjustable to select a size of the closed loop.

13. The exercising system according to claim 11, wherein the first and second attachment points are less than 8.0 inches from the demarcation line.

14. The exercising system according to claim 11, wherein each of the free ends forms a closed loop.

15. The exercising system according to claim 14, further including a pair of ring clips, each of the free ends having one of the ring clips attached thereto.

16. The exercising system according to claim 11, further including a stop being configured for engaging the door to prevent movement of the door relative to a door frame the door is pivotally coupled to.

17. The exercising system according to claim 1, wherein a length of the second strap from the first attachment point to the second attachment point is less than 18.0 inches.

18. An exercising system comprising:

a first strap having a first end, a second end, a first side, and a second side, the first strap being configured to be extendable around a door, a coupler being attached to the first end and receiving the second end to form a closed loop, the coupler being adjustable to select a size of the closed loop, the coupler comprising a ratcheting coupler, the first strap having a length from the first end to the second end being greater than 60.0 inches and less than 90.0 inches;

a demarcation line being defined on the first strap to partition the first strap into a first portion and a second portion, the first portion including the first end and the second portion including the second end, the demarcation line being less than 30.0 inches from one of the first or second ends;

a second strap being attached to the first portion at a first attachment point and being attached to the second portion at a second attachment point, the second strap being configured to be positioned over an upper edge of a door, a length of the second strap from the first attachment point to the second attachment point being less than 18.0 inches, the second strap extends beyond each of the first and second attachment points to define a pair of free ends, each of the free ends extending away from the first strap a distance of between 2.0 inches and 12.0 inches, the first and second attachment points being equidistant from the demarcation line, the first and second attachment points being less than 8.0 inches from the demarcation line, each of the free ends forming a closed loop, the second strap being attached to the first side of the first strap at each of the first and second attachment points;

a pair of ring clips, each of the free ends having one of the ring clips attached thereto; and a stop being configured for engaging the door to prevent movement of the door relative to a door frame the door is pivotally coupled to, the stop comprising a block having a top side, a bottom side, and perimeter wall extending between the top and bottom sides, the perimeter wall including a front wall, rear wall, first side wall and second side wall, the block having a notch therein extending into the front wall and upwardly through the top side, the notch being angled downwardly from a top edge of the notch positioned adjacent to the rear wall to a bottom edge of the notch positioned adjacent to the bottom side, the block being comprised of a resiliently compressible material.

* * * * *